US005170522A

United States Patent [19]

Walker

[11] Patent Number: 5,170,522

[45] Date of Patent: Dec. 15, 1992

[54] AIR ADJUSTABLE BED

[75] Inventor: Robert A. Walker, Maple Grove, Minn.

[73] Assignee: Select Comfort Corporation, Brooklyn Park, Minn.

[21] Appl. No.: 807,232

[22] Filed: Dec. 16, 1991

[51] Int. Cl.[5] ..... A61G 7/015; A61G 7/018

[52] U.S. Cl. ..... 5/615; 5/618; 5/453; 5/915

[58] Field of Search ..... 5/615, 618, 613, 453, 5/915, 660

[56] References Cited

U.S. PATENT DOCUMENTS

| | | | |
|---|---|---|---|
| 10,139 | 10/1853 | Scott | 5/615 |
| 2,769,182 | 11/1956 | Nunlist | 5/615 |
| 3,477,071 | 11/1969 | Emerson | 5/609 |
| 3,667,075 | 6/1972 | Ballard et al. | 5/615 |
| 3,775,781 | 12/1973 | Bruno et al. | 5/607 |
| 3,781,928 | 1/1974 | Swallert | 5/615 |
| 3,792,501 | 2/1974 | Kery | 5/37.1 |
| 3,879,772 | 7/1975 | Pol | 5/615 |
| 3,935,604 | 2/1976 | Collins | 5/604 |
| 4,287,620 | 9/1981 | Zur | 5/615 |
| 4,309,783 | 1/1982 | Cammack et al. | 5/615 |
| 4,527,298 | 7/1985 | Moulton | 5/615 |
| 4,839,932 | 6/1989 | Williamson | 5/615 |
| 4,873,731 | 10/1989 | Williamson | 5/615 |
| 4,928,332 | 5/1990 | Ogden et al. | 5/618 |
| 4,941,221 | 7/1990 | Kanzler | 5/615 |

OTHER PUBLICATIONS

Quality Comfort, Inc. publication, 1984.
Betterest publication, 1987.
Tech-Matic publication (undated).
American Health Mfg. publication, 1989.
American Health Mfg. publication (undated).

*Primary Examiner*—Alexander Grosz
*Attorney, Agent, or Firm*—Burd, Bartz & Gutenkauf

[57] ABSTRACT

A bed has a foundation for supporting an air mattress. The foundation has a plurality of pivotally connected transverse plates that are moved to bend the mattress to a desired contour and shape. Open top recesses in the foundation located below the plates accommodate bags have flexible walls. The bags are separately expandable and contractible to move the plates to selected elevated positions. The recesses hold the bags in lifting positions relative to the plates when the bags are inflated. The bags fit into the recesses when deflated to allow the plates to move to a horizontal position. The bed is equipped with a vibrator that is operable to vibrate the air mattress.

18 Claims, 4 Drawing Sheets

AIR ADJUSTABLE BED

FIELD OF THE INVENTION

The invention relates to body supports, such as air beds, that are adjustable to selected elevated positions particularly beds having separately air adjustable back rest and leg rest sections.

BACKGROUND OF THE INVENTION

Conventional screw and mechanical operated beds are adjustable to provide contoured support for a person resting thereon. However, these beds are high in cost and commonly are relatively heavy. Also, conventional mechanical adjustable beds are slow in operation and difficult to service.

In the past, beds have used inflatable bodies to elevate whole or selected portions of the mattress of the bed. For example, U.S. Pat. No. 2,769,182 issued to E. J. Nunlist on Nov. 6, 1956, discloses a bed having inflatable air cylinders for lifting the mattress of the bed. A pump driven by an electric motor delivers air under pressure to the air cylinders. A valve allows the person to inflate both of the cylinders or only one of the cylinders. The air cylinders can inadvertently move out of position whereby elevation and support of the mattress is uneven and unstable.

SUMMARY OF THE INVENTION

The invention is directed to an air adjustable bed having a foundation supporting an air mattress. The foundation has separately air adjustable back rest and leg rest sections that are used to elevate selected portions of the air mattress as desired. The air adjustable bed is lower in cost and weighs less than conventional mechanical adjustable beds. The air adjustable bed is faster in operation and easier to service than conventional screw and mechanical operated beds.

The air adjustable bed has a mattress foundation having a generally rectangular box frame with top support surfaces. A plurality of transverse plates engage the top surfaces of the frame. A first transverse or seat rest plate is secured to a middle portion of the frame. A first hinge pivotally connects a second transverse or back rest plate to one end of the first plate. A second hinge pivotally connects a third transverse or upper leg rest plate to the opposite end of the first plate. A third hinge pivotally connects a fourth transverse or lower leg and foot rest plate to the upper leg rest plate. The hinges allow the transverse plates to pivot to selected elevated positions.

The foundation has a first open top housing or recess located below the back rest plate. A first lift air bag is located in the first recess. When expanded, the first lift air bag has a generally triangular configuration so as to elevate the back rest plate in a generally upwardly inclined position. The base of the first lift air bag is contained within the first recess thereby preventing lateral movement of the lift air bag. When the first lift air bag is collapsed, it fits into the first recess whereby the back rest plate can rest on the top surfaces of the frame in a horizontal position.

A second lift air bag is located in a second open top housing or recess located below the leg rest plates. When expanded, the second lift air bag has a generally trapezoidal configuration so as to elevate the upper leg rest plate in a generally upwardly inclined position and hold the lower leg and foot rest plate in a generally horizontal elevated position. The base of the second air bag is contained within the second recess thereby preventing lateral movement of the lift air bag. When the second lift air bag is collapsed, it fits into the second recess whereby the leg rest plates can rest on the top surfaces of the frame in a horizontal position.

An air mattress is located on top of the foundation. The air mattress is adapted to bend with the transverse plates when the plates are elevated with the first and second lift air bags. The mattress, first lift air bag and second lift air bag are separately connected to an air pump. A hand control is used to control the operation of the pump to change the air pressure in the mattress, and also to change the air pressure in the first and second lift air bags. The pump has an electric motor driving an electric impeller for creating a supply of air under pressure. Separate solenoid valves are used to direct the air to the mattress, first lift air bag and second lift air bag. The hand control is also used to operate the solenoid valves to control the flow of air into and out of the mattress and lift air bags.

The air adjustable bed also has a vibrator operable to vibrate the mattress. The vibrator is secured to the bottom side of the seat rest plate and is controlled with the hand control.

DESCRIPTION OF PREFERRED EMBODIMENT

Referring to FIGS. 1 to 4, there is shown an air adjustable bed of the invention indicated generally at 20. Bed 20 has a generally rectangular foundation 28 that supports a mattress 21. Foundation 28 has air adjustable support sections that can be moved to selected positions with separately inflatable lift air bags 44 and 46 to elevate and incline portions of the mattress as desired. The contour and shape of mattress 21 is controlled by inflating and deflating air bags 44 and 46 to the comfort of a person resting on the mattress.

Bed 20 has a generally rectangular air mattress 21. The details of air mattress 21 are disclosed in U.S. Pat. No. 4,908,895 issued to R. A. Walker on Mar. 20, 1990, incorporated herein by reference. Air mattress 21 has a rectangular box shape with generally flat sides and ends. The walls of air mattress 21 are made of nylon vinyl, polyester, rayon vinyl or cotton rubber materials. These materials are flexible, strong, and air impervious. They also do not deteriorate over time and are water resistent. Fluid impervious continuous connections or seams permanently join peripheral adjacent portions of the walls of air mattress 21 together. The seams are lap seams forming the outer peripheral edges of the air mattresses. The seams are formed by known ultrasonic heat sealing methods. A cover 22 fits over and encloses air mattress 21. Cover 22 is drawn tightly around the air mattress, thereby protecting air mattress 21.

Figure 2:
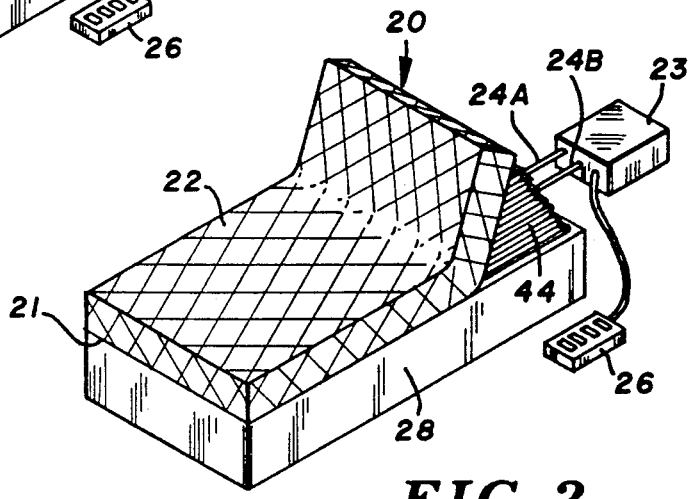
FIG. 2 is a perspective view of the air adjustable bed showing the back rest raised.
Figure 3:
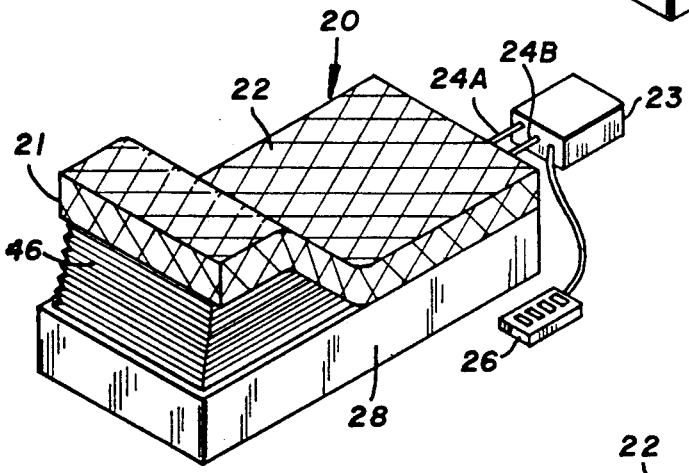
FIG. 3 is a perspective view of the air adjustable bed showing the leg rest raised.
Figure 4:
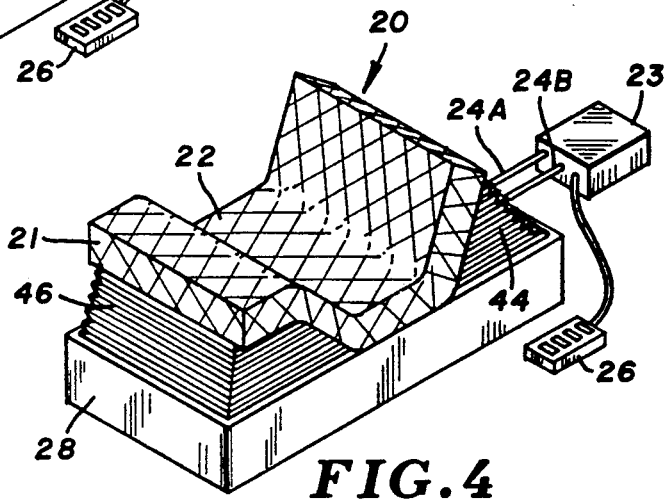
FIG. 4 is a perspective view of the air adjustable bed showing the back rest and leg rest in raised positions.

Air mattress 21 is supported on a generally rectangular boxshaped foundation 28. Foundation 28 has a width and length substantially the same as the width and length of air mattress 21. Foundation 28 has open top housings or recesses 42 and 43 that accommodate lift air bags 44 and 46. As shown in FIG. 2, lift air bag 44 is inflatable to raise the back and head support portion of air mattress 21 to an upwardly inclined position. Similarly, lift air bag 46 is inflatable so as to raise the leg and foot support area of air mattress 21 to upwardly inclined and elevated horizontal positions, as shown in FIG. 3. Both lift air bags 44 and 46 can be inflated, as shown in FIG. 4, whereby the lower portion of mattress 21 is inclined and elevated and the upper portion of the mattress is in the upwardly inclined position. Adjusting the pressure of the air in lift air bags 44 and 46 adjusts the contour and shape of mattress 21. Recesses 42 and 43 prevent air bags 44 and 46 from moving out of their lifting positions on foundation 28.

Figure 1:
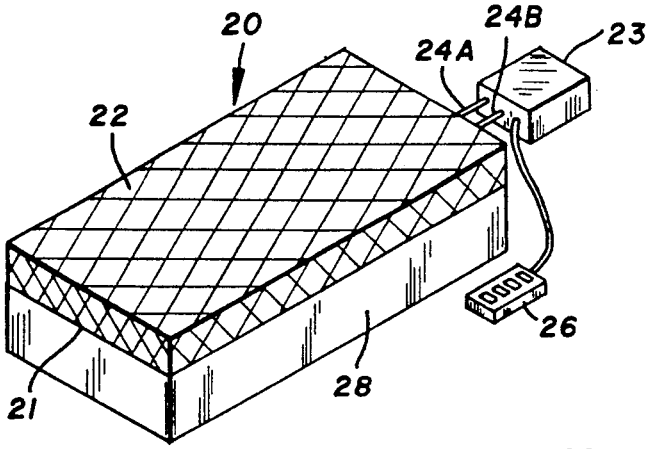
FIG. 1 is a perspective view of an air adjustable bed of the invention in the horizontal position.
Figure 5:
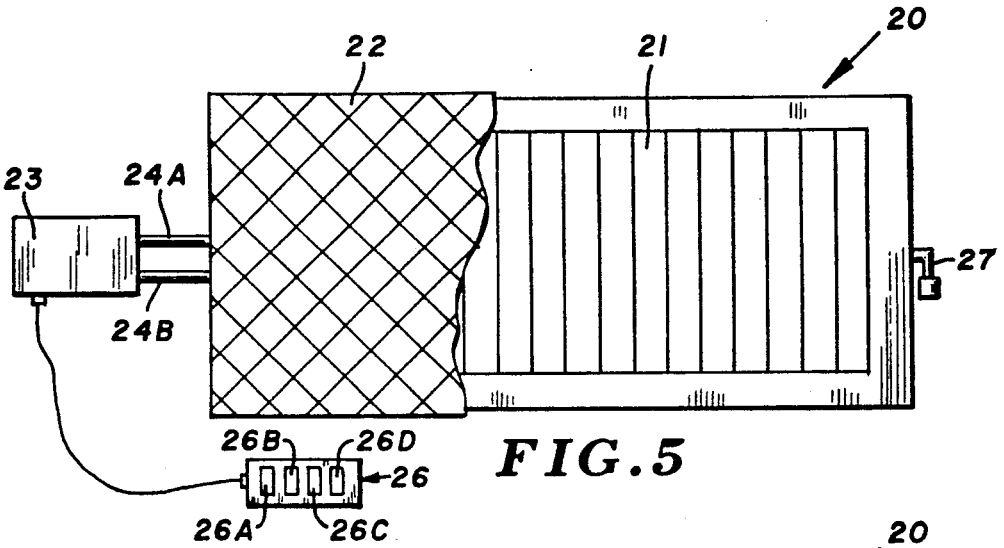
FIG. 5 is a top plan view of the air mattress and cover thereon.

Referring to FIGS. 1 and 5, air adjustable bed 20 is connected to an air pump 23 and control 26 operable to supply air mattress 21 and lift air bags 44 and 46 with air under pressure and allow air to exhaust from mattress 21 and air bags 44 and 46. The details of air pump 23 and control 26 are disclosed in U.S. Pat. No. 4,829,616 issued to R. A. Walker on May 16, 1989, incorporated herein by reference.

Control 26 has hand-operated switches 26A, 26B and 26C for regulating pump 23 to supply air to air mattress 21 and lift air bags 44 and 46. Switches 26A to 26C also control separate solenoid valves (not shown) that are used to direct air to mattress 21 and lift air bags 44 and 46. A fourth hand-operated switch 26D of control 26 is used to control the operation of a vibrator 39 secured to foundation 28. Control 26 can be incorporated in foundation 28. For example, control 26 can be mounted on side wall 74 with switches 26A to 26C accessible from the outside of wall 74. Control 26 can be located under plate 32 in the space adjacent vibrator 39 shown in FIGS. 8 and 9, with switches 26A to 26C exposed for manual operation thereof.

Figure 8:
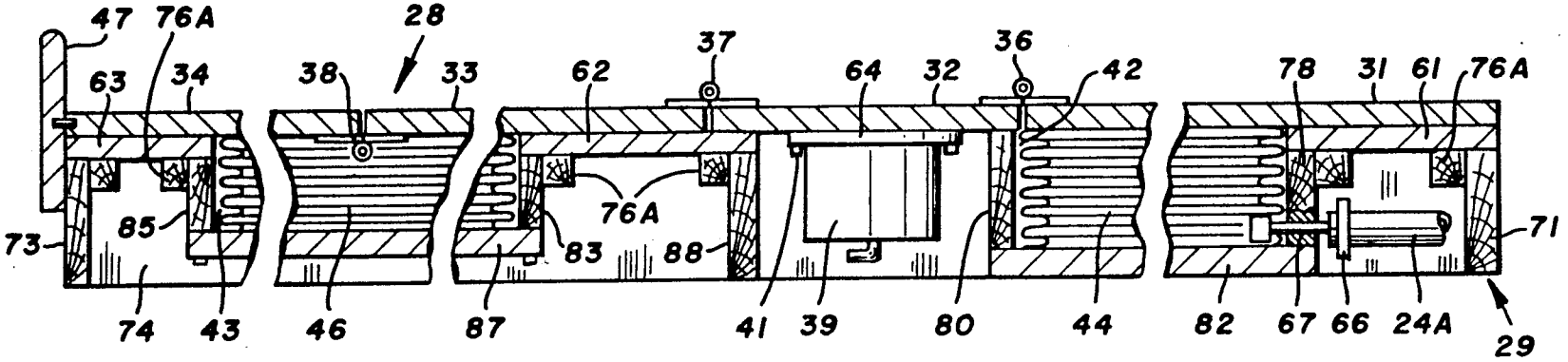
FIG. 8 is an enlarged foreshortened sectional view taken along the line 8—8 of FIG. 7.

One end of a first elongated hose 24A is attached to a first air outlet member of air pump 23. One end of a second elongated hose 24B is secured to a second air outlet member of air pump 23. Hoses 24A and 24B are elongated, flexible and elastic plastic tubes, each having a continuous passage. Hose 24A carries air between air pump 23 and lift air bag 44. As shown in FIG. 8, the outer end of hose 24A is connected to the bottom of lift air bag 44. Hose 24A extends through a bore 67 in end wall 78 of recess 42. Bracket 66 surrounds the end portion of hose 24A to hold the hose in alignment with bore 67 and the bottom of lift air bag 44.

Figure 10:
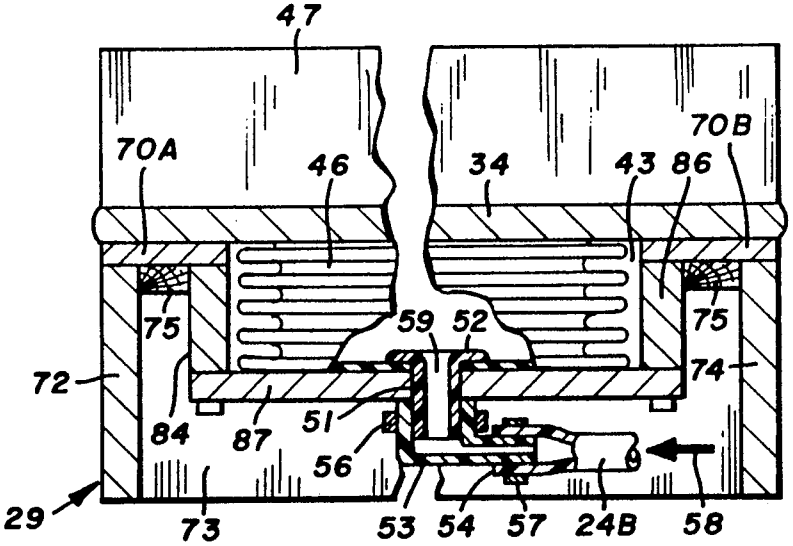
FIG. 10 is an enlarged sectional view taken along line 10—10 of FIG. 7.

Elongated hose 24B carries air between air pump 23 and lift air bag 46. As shown in FIG. 10, the outer end 54 of hose 24B telescopes over one end of an L-shaped tube 53. The opposite end of L-shaped tube 53 telescopes over the lower end of a tubular sleeve 51. Clamps 56 and 57 connect hose 24B, tube 53 and sleeve 51 together. Sleeve 51 extends through bottom wall 87 of recess 43 and the bottom wall of lift air bag 46. Sleeve 51 has a collar 52 that engages the bottom wall of bag 46 to hold the sleeve within the bag.

Returning to FIGS. 1 and 5, one end of a third elongated hose (not shown) is secured to air pump 23 to carry air between the pump and air mattress 21. Air pump 23 has an electric motor (not shown) that is coupled to a source of power. Remote handoperated switch 26A is used to control the operation of the electric motor and open a first solenoid valve. The motor drives a fan or impeller that moves air under pressure through the first valve to hose 24A and into the chamber of lift air bag 44. Remote hand-operated switch 26B is used to control the operation of the motor and open a second solenoid valve whereby air under pressure is moved through the second valve and hose 24B, as indicated by arrow 58 in FIG. 10, through passage 59 of sleeve 51 and into the chamber of lift air bag 46. Similarly, remote hand-operated switch 26C controls the operation of the motor and opens a third solenoid valve so that air under pressure moves into the chamber of air mattress 21.

Reversing hand-operated switches 26A to 26C opens the solenoid valves to exhaust the air in mattress 21 and air bags 44 and 46 as desired. A person lying on bed 20 can utilize switches 26A to 26C to operate air pump 23 and the solenoid valves to increase the pressure of the air in air mattress 21 and lift air bags 44 and 46 or cause the air in the mattress and lift air bags to be evacuated to the atmosphere, thereby adjusting the firmness of air mattress 21 and adjusting the contour and shape of the mattress.

Lift air bags 44 and 46 of bed 20 are separately inflatable and deflatable from each other whereby the position of the head and back support portion of mattress 21 can be adjusted separately from the position of the leg and foot support portion of the mattress. Further, mattress 21 can be inflated and deflated separate from lift air bags 44 and 46 allowing air pressure adjustment of the mattress independent of air pressure adjustment of the lift air bags.

Figure 6:
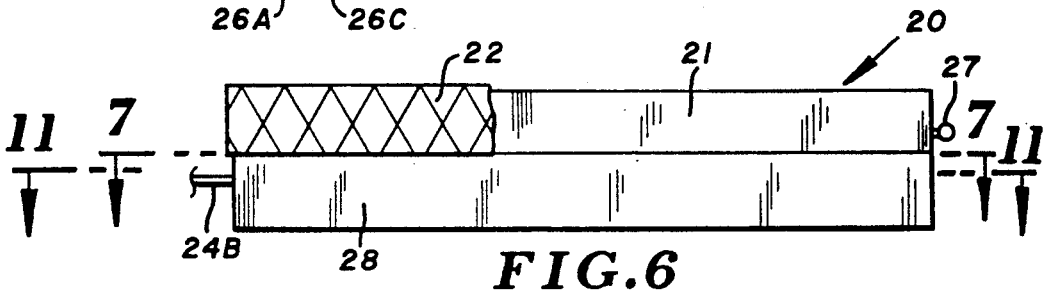
FIG. 6 is a side view of FIG. 5 showing the air mattress on the adjustable bed foundation.
Figure 7:
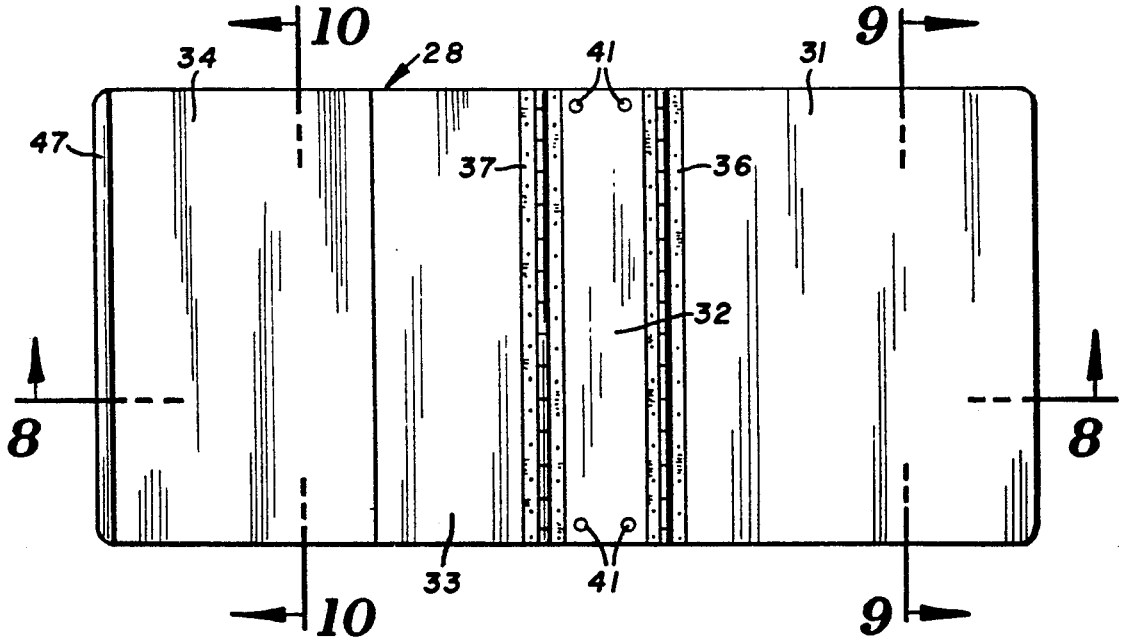
FIG. 7 is a sectional view taken along line 7—7 of FIG. 6.

Referring to FIGS. 5 and 6, an L-shaped tube assembly 27 is connected to one end of air mattress 21. Tube assembly 27 is at one end of air mattress 21 while pump 23 is connected to the opposite end of the mattress. Tube assembly 27 accommodates a pressure relief valve (not shown) operable to maintain a predetermined maximum air pressure in the chamber of mattress 21. An example of a pressure relief valve is shown in U.S. Pat. No. 4,908,895 issued to R. A. Walker on Mar. 20, 1990, incorporated herein by reference. The pressure relief valve prevents overinflation of air mattress 21, which can cause wall rupture and seal and seam separation. Preferably, the maximum air pressure is about 1 psi. An air pressure exceeding 1 psi will open the pressure relief valve allowing air to exhaust from air mattress 21 through tube assembly 27 to the atmosphere, thereby relieving the pressure of the air within mattress 21.

Air pressure relief valves operable to open in response to air pressures below 1 psi can be used with air mattress 21. Air pump 23 is used to supply air under pressure to air mattress 21. Hand control 26C is used to control pump 23 thereby regulating the pressure of the air within mattress 21 by controlling the supply of air to and exhaust of air from mattress 21. When the air pressure within the mattress drops below the maximum value, such as 1 psi, the pressure relief valve will automatically close. The pressure relief valve prevents over-inflation of air mattress 21 and mattress failure due to sudden pressure shocks imparted to the mattress or pressure increase as the mattress is shaped and contoured by inflation of lift air bags 44 and 46.

Figure 11:
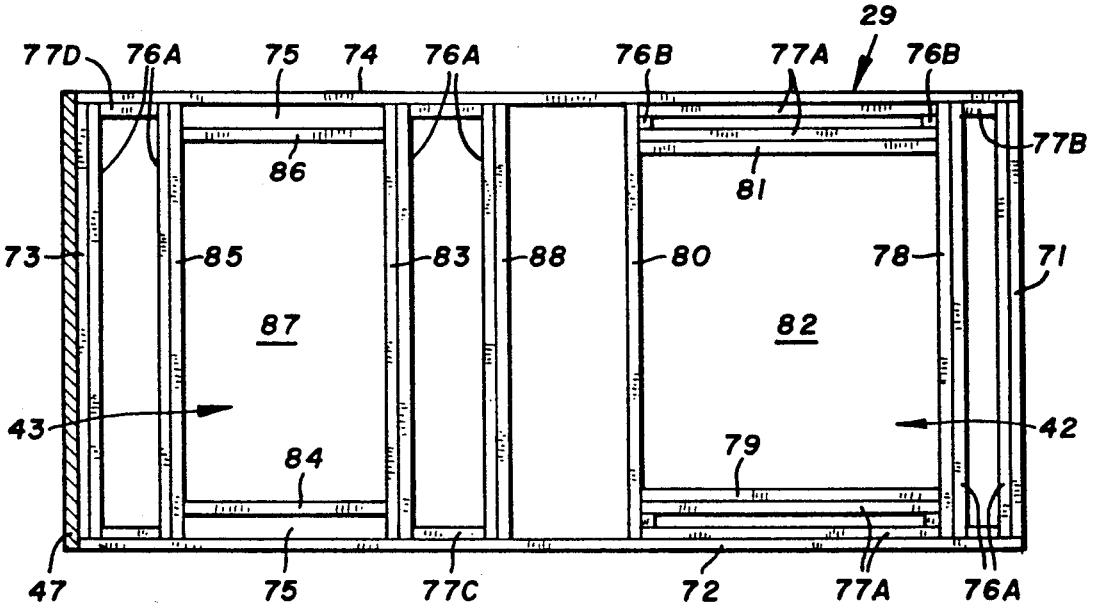
FIG. 11 is an enlarged sectional view taken along line 11—11 of FIG. 6.

Referring to FIGS. 7 to 12, a foundation 28 is used to support air mattress 21. Foundation 28 has a generally rectangular box-shaped frame 29. As shown in FIGS. 8 and 11, frame 29 has a pair of end walls 71 and 73 joined to elongated side walls 72 and 74 to form a rectangular box shape. A foot board 47 is connected to the outer end of plate 34 and extends above frame 29 to hold mattress 21 on top of foundation 28. A center wall 88 extends between the middle portions of frame side walls 72 and 74.

Frame 29 has a first rectangular open top housing or recess 42 adjacent end wall 71. First recess 42 has end walls 78 and 80 and side walls 79 and 81 that are connected to the peripheral edges of a bottom wall 82. First recess 42 accommodates lift air bag 44.

A second open top rectangular housing or recess 43 of frame 29 is located adjacent frame end wall 73. Second recess 43 has end walls 83 and 85 and side walls 84 and 86 that are secured to the peripheral edges of a bottom wall 87. Second recess 43 accommodates lift air bag 46. As shown in FIGS. 8 and 11, second recess 43 has a shorter longitudinal width than the longitudinal width of first recess 42. Also, the height of second recess 43 is less than the height of first recess 42.

Frame 29 has support structure for supporting the walls of recesses 42 and 43 and the frame. A plurality of lateral supports or braces 76A extend between frame side walls 72 and 74. Frame 29 also has a plurality of longitudinal supports or braces 77A that extend between first recess end walls 78 and 80. Longitudinal supports or braces 75 extend between second recess end walls 83 and 85 adjacent second recess side walls 84 and 86 and frame side walls 72 and 74. The top surfaces of braces 75, 76A and 77A are aligned with the tops of recesses 42 and 43. A pair of lateral supports or braces 76B extend between frame side walls 72 and 74 below first recess 42. Longitudinal braces 76B, 76C and 76D of frame 29 add further support to the walls of recesses 42 and 43 and frame 29.

Figure 9:
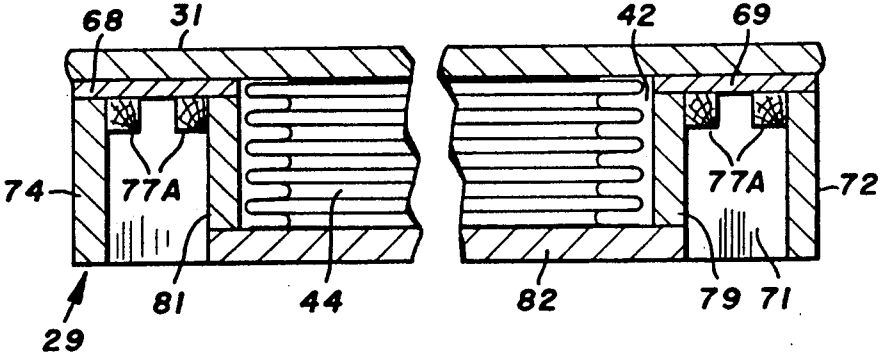
FIG. 9 is an enlarged foreshortened sectional view taken along line 9—9 of FIG. 7.
Figure 12:
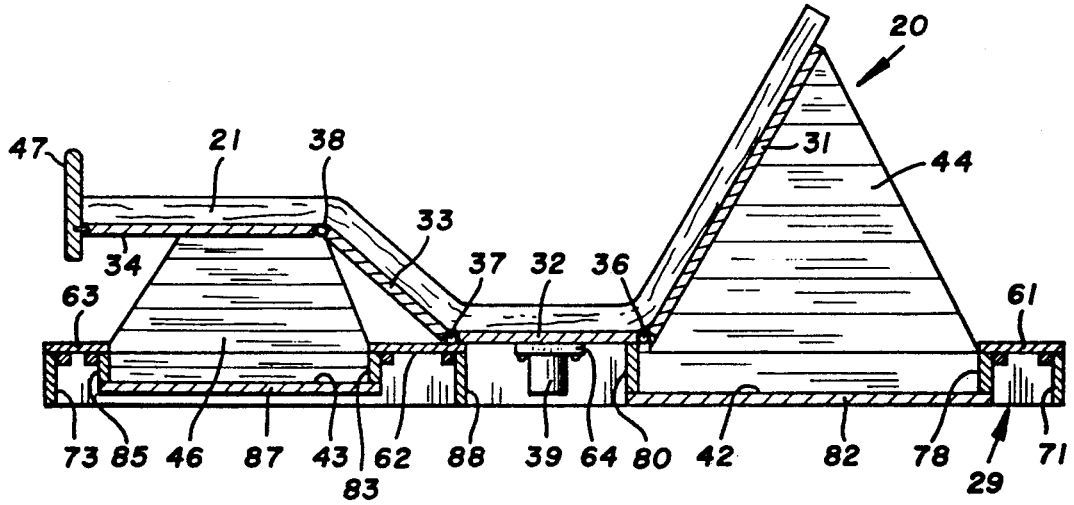
FIG. 12 is a sectional view similar to FIG. 8 showing the back rest and leg rest in raised positions.

Referring to FIGS. 8 to 10, frame 29 has a plurality of horizontal top support members 61, 62, 63, 68, 69, 70A and 70B for supporting a plurality of transverse plates 31, 32, 33 and 34. Transverse or seat rest plate 32 is secured to support member 62 and end wall 80 of recess 42. A first hinge 36 connects the inner end of transverse or back rest plate 31 to one end of seat rest plate 32. Hinge 36 enables back rest plate 31 to pivot to an upward inclined position when lift air bag 44 is inflated. A second hinge 37 pivotally connects one end of transverse or upper leg rest plate 33 to the opposite end of seat rest plate 32. A third hinge 38 pivotally connects the inner end of transverse or lower leg rest plate 34 to the opposite end of upper leg rest plate 33. Hinges 37 and 38 allow upper and lower leg rest plates 33 and 34 to pivot and move to upward inclined and elevated horizontal positions, respectively, when lift air bag 46 is inflated, as shown in FIG. 12.

Returning to FIGS. 8 to 10, first recess 42 of frame 29 is located below back rest plate 31. Second pocket or recess 43 of frame 29 is located below upper and lower leg rest plates 33 and 34. First lift air bag 44 is located in recess 42. As shown in FIG. 12, lift air bag 44, when expanded, has a generally triangular configuration so as to raise back rest plate 31 to a generally upward inclined position. The base of lift air bag 44 is located in recess 42, thereby holding the lift air bag in the proper lifting position. When lift air bag 44 is collapsed, it fits into first recess 42 so that back rest plate 31 can rest on frame top support members 61, 70A and 70B in the horizontal position.

Second lift air bag 46 is located in second recess 43 below upper and lower leg rest plates 33 and 34. Lift air bag 46 has a generally trapezoidal shape when expanded to elevate upper and lower leg rest plates 33 and 34 and to hold upper leg rest plate 33 in an upward inclined position and to also hold lower leg rest plate 34 in a generally horizontal, elevated position. The base of lift air bag 46 is located in recess 43. This holds lift air bag 46 in the proper lifting position. When lift air bag 46 is collapsed, it fits into second recess 43 so that upper and lower leg rest plates 33 and 34 will rest on frame top support members 62, 63, 68 and 69 in the horizontal position.

Referring to FIG. 8, a motor driven vibrator 39 is secured to the bottom of seat rest plate 32. Vibrator 39 has a flat top wall 64 adjacent plate 32. Fasteners 41 extend through plate 32 and vibrator top wall 64 to secure vibrator 39 to the seat rest plate. Vibrator 39 is operable to vibrate seat rest plate 32 for a lower back massage of a person resting on air mattress 21. Remote hand-operated switch 26D of control 26 controls the operation of the vibrator.

In use, a person resting on bed 20 utilizes control 26 to adjust the firmness, contour and shape of air mattress 21 as desired. Switches 26A to 26C can be used to operate air pump 23 so as to increase the pressure of the air in mattress 21 and lift air bags 44 and 46. Reversing switches 26A to 26C causes air in mattress 21 and lift air bags 44 and 46 to be exhausted therefrom. When lift air bag 44 is expanded, it raises back rest plate 31 to an upward inclined position. The base of lift air bag 44 is accommodated by recess 42 whereby lift air bag 44 is held in the lifting position below back rest plate 31. This prevents lift air bag 44 from inadvertently sliding out from underneath of back rest plate 31. When lift air bag 44 is collapsed, it fits into recess 42 whereby back rest plate 31 pivots back to the horizontal position adjacent the top surfaces of frame 29.

Expanding lift air bag 46 causes upper leg rest plate 33 to rise to an upward inclined position and causes lower leg rest plate 34 to move to a horizontal elevated position above frame 29. The base of lift air bag 46 is located in recess 43 so that lift air bag 46 is held in position below upper leg rest plate 33 and lower leg rest plate 34. Recess 43 prevents lift air bag 46 from moving out of alignment with upper and lower leg rest plates 33 and 34. When lift air bag 46 is collapsed, it fits into recess 43 so that leg rest plates 33 and 34 pivot back to the horizontal position on top of frame 29.

Lift air bag 44 is separately inflatable and deflatable from lift air bag 46 whereby back rest plate 31 is separately adjustable from upper and lower leg rest plates 33 and 34. Also, mattress 21 is inflatable and deflatable separate from lift air bags 44 and 46. Vibrator 39 can be activated to provide a massaging vibration to seat rest plate 32. This allows the contour, shape and firmness of air mattress 21 to be done quickly and easily to the personal preference of the individual resting on bed 20.

While there has been shown and described a preferred embodiment of the air adjustable bed, it is understood that changes in materials, size, shape, and arrangement of structure may be made by those skilled in the art without departing from the invention. The invention is defined in the following claims.

I claim:

1. A bed for providing support for a body comprising: a mattress, foundation means having a frame members, support means mounted on the frame member for supporting the mattress, said support means comprising a plurality of transverse plates including a first plate secured to a middle section of the frame ember, a second plate, first hinge means pivotally connecting the second plate to the first plate for movement between a horizontal position and an upward and forward inclined position, said second plate being supported on the frame member when in the horizontal position, a third plate, second hinge means pivotally connecting the third plate to the first plate for movement between a horizontal position and an upwardly and rearwardly inclined position, said third plate being supported on the frame member when in the horizontal position, and a fourth plate, third hinge means pivotally connecting the fourth plate to the third plate to maintain the fourth plate generally horizontally during pivotal movement of the third plate, said fourth plate being supported on the frame member when the third plate is in the horizontal position, lift means located below the support means expandable to elevate the support means, the frame member having a first box-shaped housing and a second box-shaped housing, each housing having a chamber and an open top located below the support means, said lift means comprising a first inflatable member located in the chamber of the first housing and engageable with the second plate and a second inflatable member located in the second housing and engageable with at least one of the third and fourth plates, and means for expanding and contracting the, first and second inflatable members to move the second plate between the horizontal positions and upward and forward inclined positions and to move the third plate between the horizontal positions and upward and rearward inclined positions thereby shaping the mattress to a selected contour and shape, the second inflatable member being a generally trapezoidal shaped air accommodating bag.

2. The bed of claim 1 wherein: the first inflatable member is a triangular shaped air accommodating bag.

3. The bed of claim 1 wherein: the means for expanding and contracting the first and second inflatable members comprises separate air flow controls for the first and second inflatable members whereby the first inflatable member is separately expandable and contractible from the second inflatable member.

4. An adjustable bed for providing support for a body comprising: a mattress, foundation means for supporting the mattress, the foundation means having a generally rectangular box-shaped frame with top support surfaces, a first plate secured to a middle portion of the frame, a second plate, first hinge means pivotally connecting the second plate to one end of the first plate, for movement between a first position and an upward and forward inclined second position, said second plate being supported on the top support surfaces of the frame when in its first position, a third plate, second hinge means pivotally connecting the third plate to an opposite end of the first plate for movement between a first position and an upward and rearward inclined second position, said third plate being supported on the top support surfaces of the frame when in its first position, a fourth plate, third hinge means pivotally connecting the fourth plate to the third plate for movement with the third plate, said fourth plate being supported on the top support surfaces of the frame when the third plate is in its first position, the frame having first housing means located below the second plate, first lift means located int eh first housing means, the first lift means expandable to elevate the second plate to its second position, second housing means located below the third and fourth plates, second lift means, comprising a generally trapezoidal shaped air accommodating bag having a base held within the second housing means when the bag is expanded, located in the second housing means, the second lift means expandable to elevate the third plate to its second position and to move the fourth plate to an elevated position, and means for expanding and contracting the first and second lift means whereby the mattress is shaped to a selected contour and shape.

5. The bed of claim 4 wherein: the first lift means comprises an air accommodating bag having a base, the base held within the first housing means when the bag is expanded.

6. The bed of claim 5 wherein: the bag fits into the first housing means when the bag is collapsed whereby the second plate rests on at least one of the top surfaces of the frame in a horizontal position.

7. The bed of claim 5 wherein: the bag is a triangular shaped member.

8. The bed of claim 4 wherein: the bag fits into the second housing means when the bag is collapsed whereby the third plate and fourth plate rest on at least one of the top surfaces of the frame in a horizontal position.

9. The bed of claim 4 wherein: the means for expanding and contracting the first and second lift means is an air pump, the air pump operable to separately inflate and deflate the first lift means, second lift means and the mattress.

10. The bed of claim 9 including: means to control the operation of the air pump so as to regulate the air pressure in the mattress, and the first and second lift means.

11. The bed of claim 4 including: means secured to the first plate operable to vibrate the mattress.

12. An adjustable bed for providing support for a body comprising: a mattress, foundation means for supporting the mattress having a generally rectangular box-shaped frame with top support surfaces, a first plate secured to a middle portion of the frame, a second plate, first hinge means pivotally connecting the second plate to one end of the first plate for movement between a first position and an upwardly and forwardly inclined second position, said second plate being supported on the top support surfaces of the frame when in its first position, third plate, second hinge means pivotally connecting the third plate to an opposite end of the first plate for movement between a first position and an upward and rearward inclined position, said third plate being supported on the top support surfaces of the frame when in its first position, first housing means located below the second plate, first lift means located in the first housing means expandable to pivot the second plate to its second position, second housing means located below the third plate, second lift means located in the second housing means below the third plate operable to expand and elevate the third plate to its second position, and means for expanding and contracting the first and second lift means whereby the mattress is shaped to a selected contour and shape, the second lift means comprising a generally trapezoidal shaped air accommodating bag having a base held within the second housing means when the bag is expanded, with the bag fitting in the second housing means when the bag is collapsed, whereby the third plate rests on at least one of the top surfaces of the frame in a horizontal position.

13. The bed of claim 12 wherein: the first lift means comprises an air accommodating bag having a base, the base being held within the first housing means when the bag is expanded.

14. The bed of claim 13 wherein: the bag fits into the first housing means when the bag is collapsed whereby the second plate rests on at least one of the top surfaces of the frame in a horizontal position.

15. The bed of claim 13 wherein: the bag is a triangular shaped inflatable member.

16. The bed of claim 12 wherein: the means for expanding and contracting the first and second lift means is an air pump, said air pump being operable to separately inflate and deflate the first lift means and second lift means.

17. The bed of claim 16 including: means to control the operation of the air pump so as to regulate the air pressure int he first and second lift means.

18. The bed of claim 12 including: means secured to the first plate operable to vibrate the mattress.

* * * * *